US005446982A

United States Patent [19]

Blaszynski

[11] Patent Number: 5,446,982

[45] Date of Patent: Sep. 5, 1995

[54] MOTION CONTROLLER HANDREST WITH LEVER LOCK

[75] Inventor: Robert H. Blaszynski, Waukesha, Wis.

[73] Assignee: Harnischfeger Corporation, Brookfield, Wis.

[21] Appl. No.: 159,450

[22] Filed: Nov. 30, 1993

[51] Int. Cl.[6] ..... G05G 1/04

[52] U.S. Cl. ..... 37/396; 74/526; 74/528

[58] Field of Search ..... 74/525, 526, 528, 608, 74/609, 612; 414/138, 139, 140; 37/394, 395, 396, 397, 398

[56] References Cited

U.S. PATENT DOCUMENTS

| | | | |
|---|---|---|---|
| 1,241,419 | 9/1917 | Mossman | 74/525 |
| 3,522,746 | 8/1970 | Reynolds | 74/526 |
| 4,171,053 | 10/1979 | Cecce | 414/139 X |
| 4,183,257 | 1/1980 | Lovenduski | 74/526 X |
| 4,227,428 | 10/1980 | Zifferer et al. | 74/526 |
| 4,474,075 | 10/1984 | Kobelt | 74/526 |
| 4,548,094 | 10/1985 | Huitema et al. | 74/526 |
| 4,633,728 | 1/1987 | May | 74/526 X |
| 4,887,483 | 12/1989 | Vollath | 74/526 |

*Primary Examiner*—Randolph A. Reese
*Assistant Examiner*—Robert Pezzuto
*Attorney, Agent, or Firm*—Michael, Best & Friedrich

[57] ABSTRACT

A dragline comprises a main chassis, a mechanism for moving the main chassis over the ground, a boom mounted on the main chassis, a sheave rotatably mounted on the boom, a dragline bucket, a hoist rope reeved over the sheave and having an end connected to the bucket to raise and lower the bucket, a drag rope connected to the bucket to pull the bucket toward the main chassis and to allow the bucket to move away from the main chassis, and an operator station on the main chassis, the operator station including a control lever apparatus for permitting an operator to control one of the mechanism, the hoist rope and the drag rope. The control lever apparatus includes a housing having therein a control mechanism for operating one of the mechanism, the hoist rope and the drag rope, a control lever mounted on the housing and operably connected to the control mechanism, the control lever being movable in a single plane relative to the housing, a shroud generally exterior of the housing, the shroud providing a rest for supporting an operator's hand gripping the control lever, and a locking mechanism mounted on the shroud and including a locking member which is movable relative to the housing for selectively capturing the control lever and thereby preventing movement of the control lever relative to the housing.

23 Claims, 3 Drawing Sheets

MOTION CONTROLLER HANDREST WITH LEVER LOCK

BACKGROUND OF THE INVENTION

1. Field of the Invention

The present invention relates to operator controls for apparatus such as earth moving equipment or construction and mining equipment.

2. Description of Related Art

Conventional mining equipment includes an operator control station having one or more control levers for controlling various components of the equipment. A control lever is typically pivotally mounted on a housing which contains a control mechanism operated by the lever. The control mechanism is operably connected to the component being controlled.

SUMMARY OF THE INVENTION

The invention provides an improved control lever apparatus of the type described above. The control lever apparatus includes a locking mechanism exterior of the housing for capturing the control lever and thereby preventing movement of the control lever relative to the housing. The locking mechanism preferably includes a locking member which is movable relative to the control lever for capturing the control lever.

The invention also provides a control lever apparatus including a shroud exterior of the housing. The shroud has an upper surface which provides a rest for an operator's hand gripping the control lever. Preferably, the shroud supports the above-mentioned locking member.

More particularly, the invention provides a control lever apparatus for operating a dragline or similar equipment. The control lever apparatus includes a housing which is mounted to a surface by fasteners. The housing has therein a control mechanism for operating the walking mechanism, hoist rope or drag rope of the dragline. A control lever is movably mounted on the housing and operably connected to the control mechanism. The control lever is movable in a single plane relative to a vertical position. A generally U-shaped, plate-like shroud is mounted exterior of the housing by the same fasteners mounting the housing to the surface. The upper surface of the shroud provides a handrest for the operator. A locking member or plate is supported underneath the upper portion of the shroud for sliding movement relative thereto between an extended position and a retracted position. The plate has therein a notch. When the plate is extended, the notch captures the control lever in the vertical position and thereby prevents movement of the control lever relative to the housing.

In conventional draglines, the brakes for the walking mechanism, hoist rope, and drag rope are automatically released or disengaged when the control lever is moved from the vertical position. The locking mechanism prevents accidental movement of the control lever from the vertical position, such as when the control lever is accidentally bumped by the operator leaving his seat to take a break, and thereby prevents release of the brakes and unexpected movement of the component controlled by the control lever apparatus. By supporting an operator's hand gripping the control lever, the shroud reduces operator fatigue. The shroud and locking mechanism can be mounted exterior of the control lever housing on new or existing equipment with minimal expense and complexity.

Other features and advantages of the invention will become apparent to those skilled in the art upon review of the following detailed description, claims and drawings.

Figure 1:
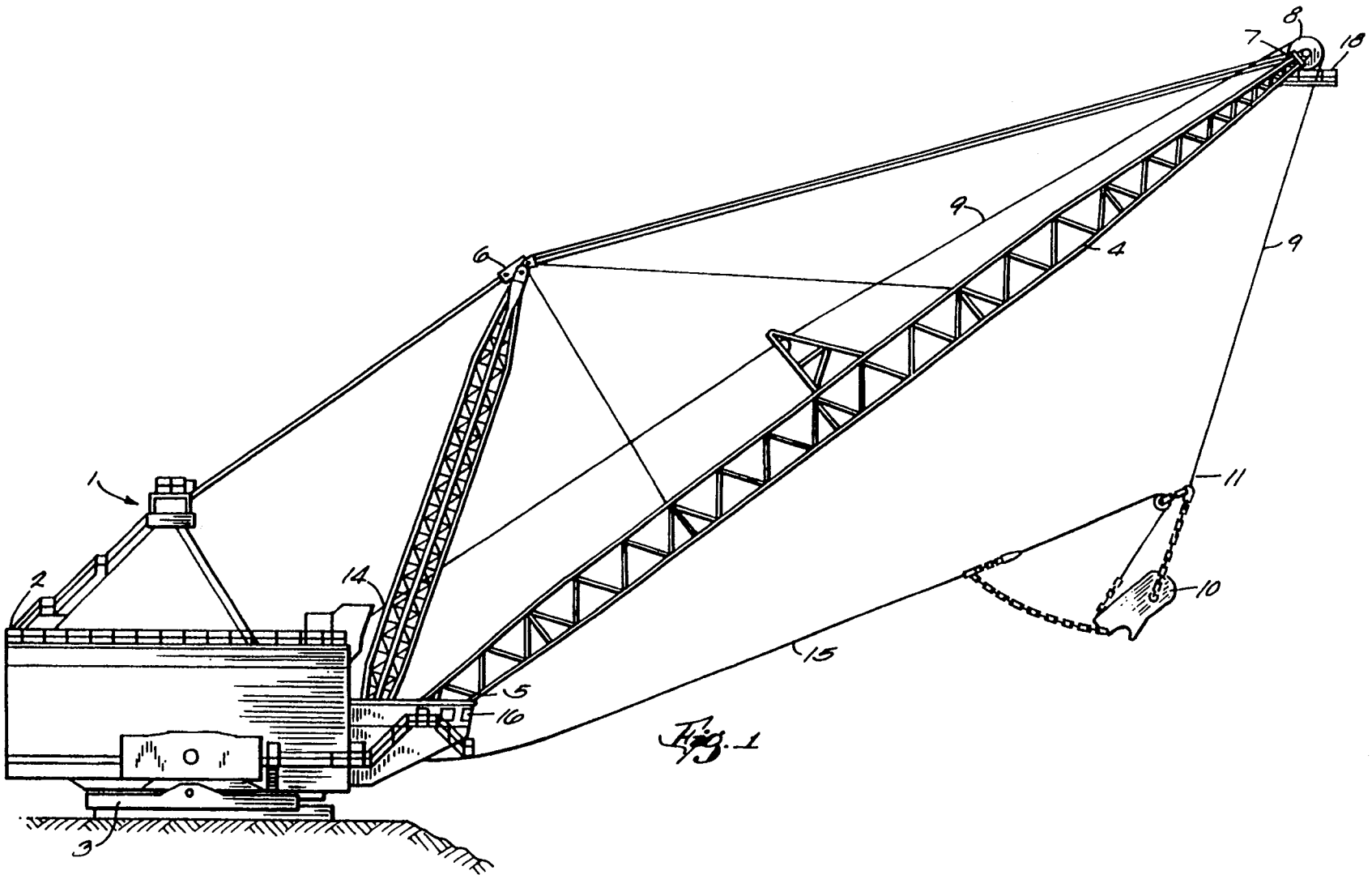
FIG. 1 is a side elevational view of a dragline excavating machine embodying the invention.

Before one embodiment of the invention is explained in detail, it is to be understood that the invention is not limited in its application to the details of construction and the arrangement of components set forth in the following description or illustrated in the drawings. The invention is capable of other embodiments and of being practiced or being carried out in various ways. Also, it is to be understood that the phraseology and terminology used herein is for the purpose of description and should not be regarded as limiting.

DESCRIPTION OF THE PREFERRED EMBODIMENT

Illustrated in the drawings is a dragline 1 embodying the invention. The dragline 1 includes a main chassis 2 which has a walking mechanism 3 operable in known manner to move the dragline 1. A boom 4 is mounted at its lower end or foot 5 on the main chassis 2. A mast assembly 6 is provided to support the upper end 7 of the boom 4. A sheave 8 is rotatably mounted on the upper end 7 of the boom 4, and an elongated lifting element or hoist rope 9 is reeved over the sheave 8. A dragline bucket 10 is suspended from one end 11 of the hoist rope 9. The other end 14 of the hoist rope 9 is connected to a conventional hoist drum (not shown) on the chassis 2. The hoist drum is operated in known manner to raise and lower the hoist rope 9 and bucket 10. The dragline also has a conventional service platform 18 located at the upper end 7 of the boom 4.

One or more drag ropes 15 are connected to the bucket 10. In order to simplify the drawing, FIG. 1 shows a single drag rope 15 connected to the bucket 10, but in actual practice more than one drag rope 15 is frequently required. The drag rope 15 is controlled by an operator to pull the bucket 10 toward the main chassis 2 and to release the drag rope 15 to allow the bucket 10 to move away from the main chassis 2. The dragline 1 also includes an operator station 16, described in further detail below, from which the operator controls the dragline 1. The dragline 1 as thus far described is conventional and will not be described in greater detail.

The operator station 16 includes (see FIG. 2) a seat 20 for the operator, and right and left control lever apparatus 21 and 22 for controlling the walking mechanism 3, hoist rope 9 and drag rope 15. The right control lever apparatus 21 controls the hoist rope 9. Depending upon the position of a mode selection switch (not shown), the left control lever apparatus 22 controls the drag rope 15 and walking mechanism 3. However, the controls as stated can be just the opposite. The control lever apparatus 21 and 22 are mirror images of each other, and only the control lever apparatus 21 will be described in detail.

Figure 3:
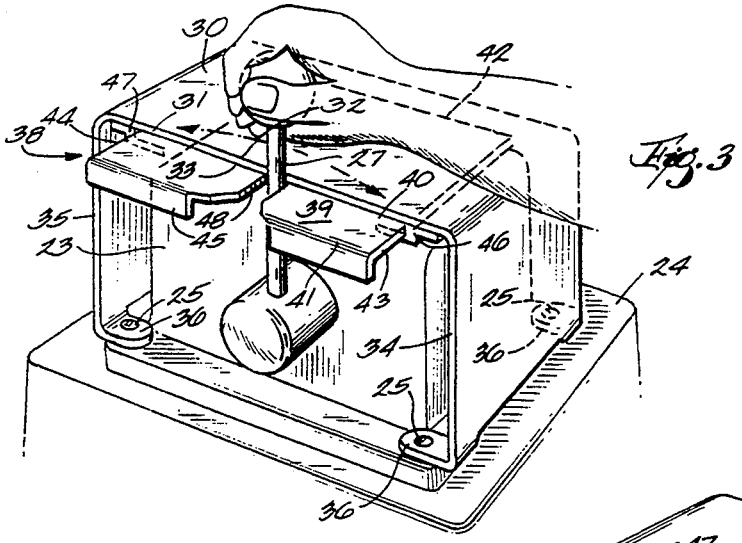
FIG. 3 is a perspective view of the control lever apparatus with the control lever captured in a vertical position by the locking member.
Figure 6:
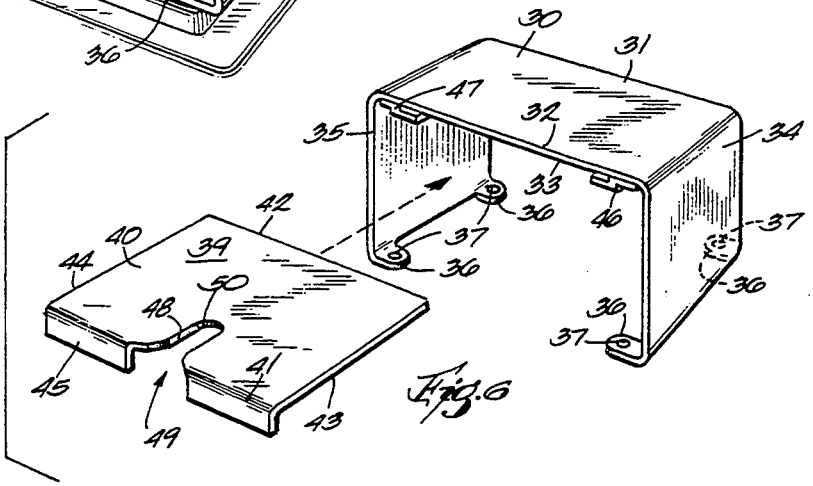
FIG. 6 is an exploded view of the shroud and locking member.
Figure 5:
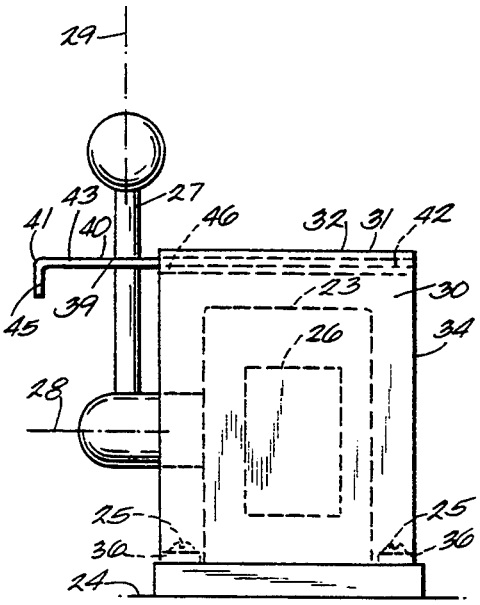
FIG. 5 is an end view taken generally along line 5—5 in FIG. 4.
Figure 4:
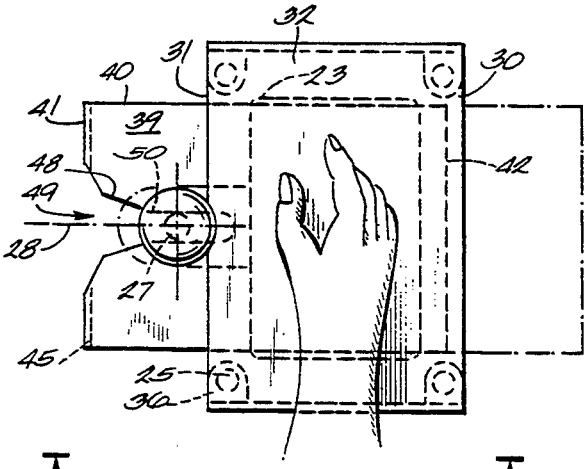
FIG. 4 is a top plan view of the control lever apparatus shown in FIG. 3.

The control lever apparatus 21 includes (see FIGS. 2–6) a housing 23 fixed on a generally horizontal surface 24 by fasteners 25. The housing 23 has therein (see FIG. 5) a control mechanism 26 (shown schematically) for operating the drag rope 15. An elongated control lever 27 (FIGS. 3–5) is operably connected to the control mechanism 26. The control lever 27 is pivotally movable about a horizontal axis 28 (FIGS. 4 and 5) relative to the housing 23 and is movable relative to a vertical position illustrated in FIGS. 3–5. In the illustrated arrangement, the control lever 27 is movable only in a single vertically extending plane 29 (FIGS. 4 and 5). Movement of the lever 27 is indicated by broken arrows in FIG. 3. In other arrangements (not shown), movement of the control lever 27 is not restricted to a single plane.

A shroud 30 is mounted exterior of the housing 23. The shroud 30 is a plate-like member bent into an inverted U-shape. The shroud 30 includes an upper portion 31 having opposed upper and lower surfaces 32 and 33. The upper surface 32 provides a rest for supporting (see FIGS. 3 and 4) an operator's hand gripping the control lever 27. In an alternative arrangement (not shown), the upper surface 32 is padded with a material such as foam or fabric to ensure comfort of the operator's hand. The shroud 30 also includes (see FIGS. 3 and 6) opposite side portions 34 and 35 depending from the upper portion 31. The lower end of each side portion 34 and 35 has thereon two inwardly extending ears 36. The fasteners 25 extend through apertures 37 (FIG. 6) in the ears 36, through apertures (not shown) in the housing 23, and into apertures (not shown) in the surface 24 to secure the shroud 30 and the housing 23 to the surface 24.

Figure 2:
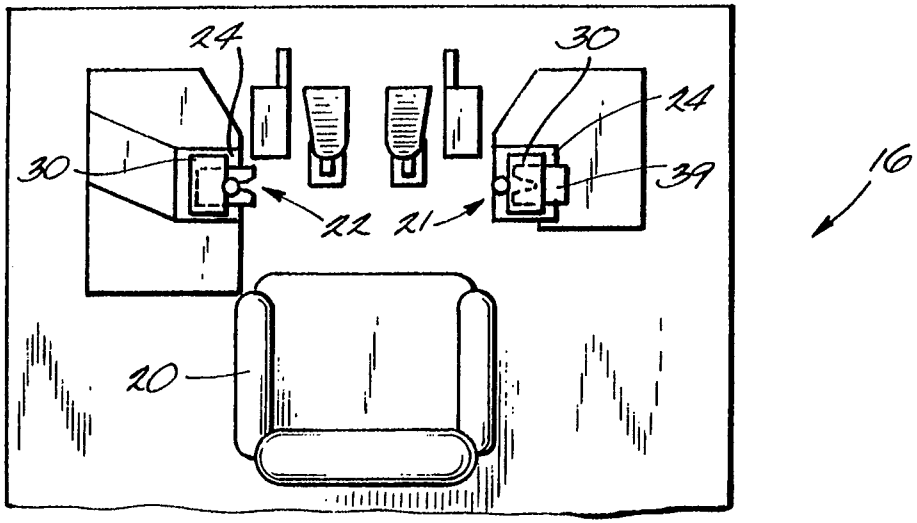
FIG. 2 is a top plan view of the operator control station of the dragline.

A locking mechanism 38 (FIG. 3) is mounted on the shroud lower surface 33. The locking mechanism 38 includes (see FIG. 6) a locking member or plate 39 having an upper surface 40, opposed front and rear edges 41 and 42, opposed right and left edges 43 and 44 and a flange 45 depending from the front edge 41. The plate 39 is slidably supported by brackets 46 and 47 which are mounted on the lower surface 33 of the shroud upper portion 31 and which respectively engage the right and left edges 43 and 44 of the plate 39. The plate 39 is slidable relative to the shroud 30 between an extended position shown in FIGS. 3, 4 and 5 and a retracted position shown in FIG. 2 and shown in phantom in FIG. 4. When the plate 39 is in the retracted position, the front edge 41 and a substantial portion of the plate 39 are beneath the shroud upper portion 31. The remainder of the plate 39 extends to the right of the shroud 30 as shown in FIG. 2. The front edge 41 is proximate the control lever 27 and has therein (see FIGS. 3, 4 and 6) a notch 48 for capturing the control lever 27 and thereby preventing movement of the control lever 27 relative to the housing 23. The notch 48 has (see FIG. 6) an open end 49 and an inner portion 50. The notch 48 is flared at the open end 49, and the width of the notch 48 at the open end 49 is sufficiently greater than the outside diameter of the control lever 27 that the control lever 27 is easily guided into the notch 48. The inner portion 50 of the notch 48 has a width approximately equal to, but slightly greater than, the outside diameter or width of the control lever 27, to substantially prevent any movement of the control lever 27 when the control lever 27 is captured in the inner portion 50 of the notch 48. Movement of the control lever 27 is prevented to the extent necessary to prevent the brake on the hoist rope 9 from being released as long as the control lever 27 is housed in the inner portion 50 of the notch 48. The front edge 41 of the plate 39 engages the control lever 27 to prevent capture of the control lever 27 when the control lever 27 is not in the vertical position shown in FIG. 1. The flange 45 extends downwardly from the front edge 41 to prevent the plate 39 from sliding too far into the brackets 46 and 47 in the retracted position, and to provide a grip for the operator to slide the plate 39 between the retracted and extended positions.

In other embodiments of the invention (not shown), the locking mechanism 38 can be configured differently. For example, the locking member 39 may rotate or move in a manner other than sliding relative to the shroud 30. Also, in some embodiments, the locking member 39 may be fixed such that the control lever 27 is moved into the notch 48. Further, in some embodiments, the locking mechanism 38 may be mounted on the control lever 27 or housing 23 instead of on the shroud 30.

I claim:

1. A control lever apparatus comprising:

a housing having therein a control mechanism for operating equipment;

a control lever mounted on said housing and operably connected to said control mechanism;

a shroud separate from and exterior of said housing; and a locking mechanism supported by said shroud exterior of said housing for selectively capturing said control lever and thereby preventing movement of said control lever relative to said housing.

2. The apparatus as set forth in claim 1 wherein said control lever is movable relative to a position, and said locking mechanism captures said control lever only in said position.

3. The apparatus as set forth in claim 1 wherein said locking mechanism includes a locking member moveable relative to said control lever for capturing said control lever.

4. The apparatus as set forth in claim 3 wherein said locking member includes a notch and is movable for capturing said control lever in said notch.

5. The apparatus as set forth in claim 4 wherein said control lever is movable relative to a position, and said locking mechanism includes portions which engage said control lever for preventing capture of said control lever except when said control lever is in said position.

6. The apparatus as set forth in claim 5 wherein said locking member is a plate having an edge proximate said control lever, said edge having therein a notch for capturing said control lever.

7. The apparatus as set forth in claim 6 and further comprising a shroud generally exterior of said housing, and wherein said shroud includes a plate-like upper portion having opposed upper and lower surfaces, said locking member is slidably mounted beneath said lower surface, said locking member is movable between an extended position wherein said control lever is captured in said notch and a retracted position wherein said locking member is substantially beneath said shroud upper portion, and one of said shroud and said locking mechanism provides a rest for supporting an operator's hand gripping said control lever.

8. The apparatus as set forth in claim 1 wherein one of said shroud and said locking mechanism provides a rest for supporting an operator's hand gripping said control lever.

9. The apparatus as set forth in claim 8 wherein said shroud includes an upper surface providing said rest.

10. Apparatus as set forth in claim 1 wherein said shroud includes an upper portion extending above said housing and opposite side portions which depend from said upper portion and which extend on opposite sides of said housing.

11. Apparatus as set forth in claim 10 and further comprising a mounting surface, and wherein each of said side portions is secured to said surface by fasteners which also secure said housing to said surface.

12. Apparatus as set forth in claim 1 wherein said locking mechanism includes a locking member which moves translationally to capture said control lever.

13. Apparatus as set forth in claim 1 wherein said locking mechanism is supported above said housing.

14. Apparatus as set forth in claim 1 wherein said control lever is movable in a single plane relative to said housing.

15. A control apparatus comprising:

a housing having therein a control mechanism for operating equipment;

a control lever movably mounted on said housing and operably connected to said control mechanism; and a shroud exterior of and separate from said housing, said shroud providing a rest for supporting an operator's hand gripping said control lever wherein said shroud includes an upper portion extending above said housing and opposite side portions which depend from said upper portion and which extend on opposite sides of said housing, said upper portion providing said rest.

16. The apparatus as set forth in claim 15 wherein said shroud is fixed to said housing.

17. Apparatus as set forth in claim 15 and further comprising a mounting surface, and wherein each of said side portions is secured to said surface by fasteners which also secure said housing to said surface.

18. A dragline comprising:

a main chassis;

a mechanism for moving said main chassis over the ground;

a boom mounted on said main chassis;

a sheave rotatably mounted on said boom;

a dragline bucket;

a hoist rope reeved over said sheave, said hoist rope having an end connected to said bucket to raise and lower said bucket;

a drag rope connected to said bucket to pull said bucket toward said main chassis and to allow said bucket to move away from said main chassis;

an operator station on said main chassis, said operator station including a control lever apparatus for permitting an operator to control one of said mechanism, said hoist rope and said drag rope, said control lever apparatus including a housing having therein a control mechanism for operating said one of said mechanism, said hoist rope and said drag rope, a control lever mounted on said housing and operably connected to said control mechanism, said control lever being movable in a single plane relative to said housing, a shroud separate from and exterior of said housing, said shroud providing a rest for supporting an operator's hand gripping said control lever, and a locking mechanism mounted on said shroud and including a locking member which is movable relative to said housing for selectively capturing said control lever and thereby preventing movement of said control lever relative to said housing.

19. A dragline as set forth in claim 18 wherein said operator station includes a surface, said housing is fixed to said surface by fasteners, and said shroud is fixed to said housing by said fasteners.

20. A dragline as set forth in claim 18 wherein said locking mechanism is supported above said housing.

21. A dragline as set forth in claim 19 wherein said shroud includes an upper portion extending above said housing and opposite side portions which depend from said upper portion and which extend on opposite sides of said housing.

22. A dragline as set forth in claim 21 and further comprising a mounting surface, and wherein each of said side portions is secured to said surface by fasteners which also secure said housing to said surface.

23. A dragline as set forth in claim 18 wherein said locking member moves translationally to capture said control lever.

* * * * *